US005699643A

United States Patent [19]

Kinard

[11] Patent Number: 5,699,643

[45] Date of Patent: Dec. 23, 1997

[54] FLOOR SUPPORT FOR EXPANSIVE SOILS

[76] Inventor: George Kinard, 10350 W. 65th Ave., Arvada, Colo. 80004

[21] Appl. No.: 810,755

[22] Filed: Feb. 27, 1996

[51] Int. Cl.[6] ..... E02D 5/00

[52] U.S. Cl. ..... 52/742.14; 52/741.11; 52/167.1; 52/169.1; 52/294; 52/309.12; 52/324; 405/229; 264/31

[58] Field of Search ..... 52/167.1, 169.1, 52/294, 309.4, 309.12, 309.17, 324, 320, 380, 403.1, 250, 741.1–741.14, 742.14; 405/229; 264/31

[56] References Cited

U.S. PATENT DOCUMENTS

| | | | |
|---|---|---|---|
| 3,000,144 | 9/1961 | Kitson | 52/309.12 X |
| 3,626,702 | 12/1971 | Monahan | 52/169.1 X |
| 4,508,472 | 4/1985 | Handy et al. | 52/167.1 X |
| 4,685,367 | 8/1987 | Workman | 52/169.1 X |
| 4,811,770 | 3/1989 | Rapp | 52/309.12 |
| 4,945,697 | 8/1990 | Ott et al. | 52/403.1 |
| 5,067,298 | 11/1991 | Petersen | 52/309.12 X |
| 5,146,721 | 9/1992 | Candiracci | 52/309.17 X |
| 5,352,064 | 10/1994 | Carruthers et al. | 405/229 |
| 5,369,926 | 12/1994 | Borland | 52/309.17 X |

FOREIGN PATENT DOCUMENTS

| | | | |
|---|---|---|---|
| 909538 | 9/1972 | Canada | 52/408 |

*Primary Examiner*—Robert Canfield

*Attorney, Agent, or Firm*—John R. Ley; John B. Phillips

[57] ABSTRACT

A floor is supported above an area of expansive soil by foam blocks defining an elongated channel along a top surface of the foam block. A plurality of supports attached to a bottom surface of each foam block positions the bottom surface of the foam block a predetermined distance above the soil and on a level substantially equal to the level of a flat surface defined by opposing foundation walls. The foam blocks are aligned between the opposing foundation walls and the elongated channels are filled with concrete to form concrete joists extending between the flat surfaces of the opposing foundation walls. The floor is installed on top of the concrete joists and the foam blocks while a void is effectively maintained between the concrete joists and the expansive soil. The supports may be made from a crushable foam material to increase the effective size of the void. Additionally, the supports are detachable from the bottom surface of the foam blocks to further increase the effective size of the void between the concrete joists and the soil. The channels are preferably trapezoidal in shape to prevent downward movement of the foam blocks relative to the concrete joists.

24 Claims, 4 Drawing Sheets

Fig. 7
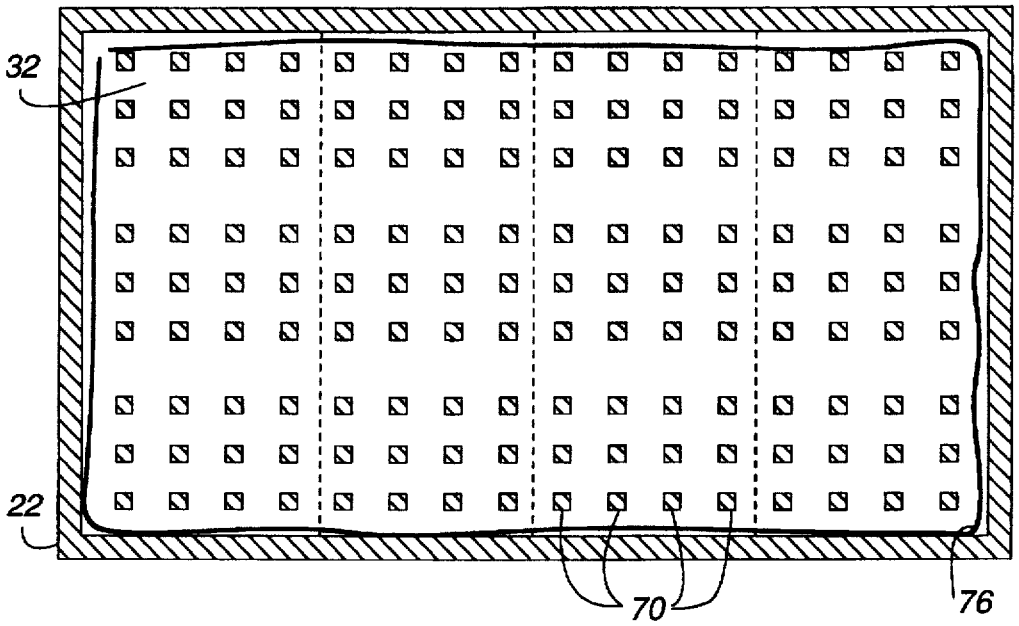
Fig. 8
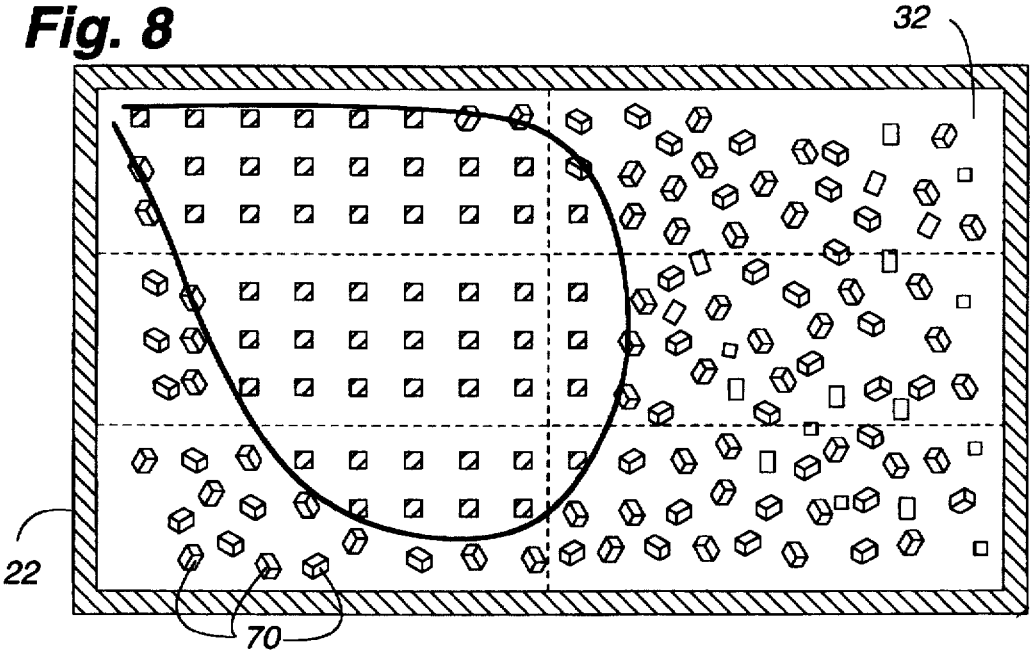
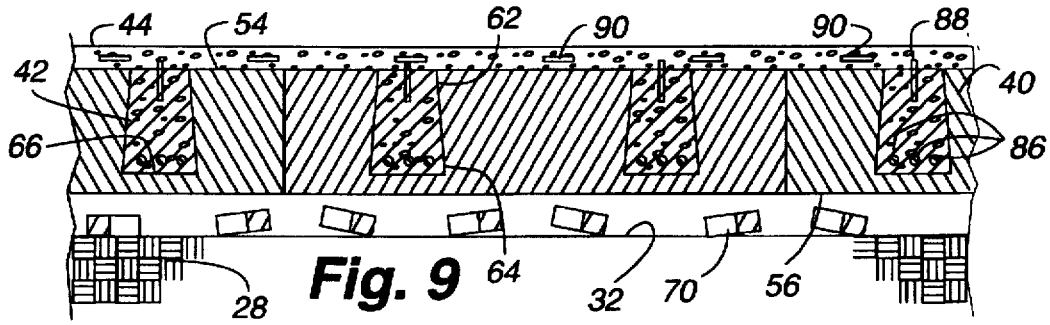
Fig. 9

FLOOR SUPPORT FOR EXPANSIVE SOILS

FIELD OF THE INVENTION

This invention relates generally to suspending a floor above expansive soils to prevent damage to the floor due to soil heave. More particularly, the present invention relates to a new and improved system and method for supporting a floor, and preferably a concrete slab floor, while maintaining a space between the floor and the expansive soil below the floor to provide sufficient room for the expansive soil to swell upward without damaging the floor.

BACKGROUND OF THE INVENTION

Expansive or swelling soils are present in varying degrees across the United States and many regions of the world. Expansive soils expand through an electrochemical process when water is added to the soils. Thus, expansive soils can create the greatest problems when they are present in semi-arid climates (such as in high mountainous plains) where a water deficit normally exists prior to the development of residential communities.

Once a residential community is built upon an area of expansive soils, the soil environment is dramatically changed. Much of the ground surface, which was previously open to the atmosphere, is covered by houses, driveways, streets and sidewalks. Such pavements and structures limit the amount of moisture which can evaporate from the ground. Additionally, homeowners will typically plant a grass yard or create other landscaping which requires constant irrigation during the summer season. For example, it is not uncommon for homeowners in semi-arid climates, which normally receive less than 20 inches of annual precipitation, to add an additional 40–60 inches of water to their lawns during the summer season. This combination of covering the soil with pavement and structures (thereby preventing natural evaporation) and then irrigating lawns and gardens during the summer season, combined with the tendency of normally dry soils to draw the water below the surface before it can evaporate, tends to unnaturally increase the moisture levels in the soils below building sites. Experience has shown that soil wetting depths of more than 15 feet below the ground surface are not uncommon in such semi-arid climates.

This unnatural wetting of the soils activates the expansive soils and causes the soil to swell or heave upward. As the expansive soils swell, they exert upward forces on surface structures such as streets, buried utilities and, most significantly, concrete slab floors. These lifting forces are powerful enough to actually lift such surface structures. Indeed, swelling soils have directly influenced the design, construction and performance of many "slab-on-grade" structures (i.e., concrete slabs supported directly on the ground) built in areas with expansive soils.

To account for the potential of basement slab-on-grade floors to heave upward, builders have conventionally used slip joints between the basement slab and the foundation walls of a house to allow the basement slab to rise and fall relative to the foundation walls. By supporting the foundation walls on caissons which are preferably anchored to bedrock below the level of soil wetting, the foundation walls are substantially immune to swelling soils. Therefore, the use of slip joints can provide some tolerance for swelling soils, provided that the soil expands evenly so that the concrete slab stays level as it rises and falls.

However, because the amount of wetting and soil swell typically varies from one spot to another, the amount of heave or lifting of slab-on-grade structures also varies. The variation in upward movement of the soil from one spot to another is referred to as differential heave. Slab-on-grade structures such as basement floors can tolerate very little differential heave because, even though concrete has great compressive strength, it offers very little tensile strength and thus does not bend well. As a result, concrete slab-on-grade floors often crack in response to differential heave, and in areas of high swelling soils the amount of differential heave and subsequent cracking can be severe.

Because basements were historically used as utility rooms, homeowners were not overly sensitive to damage to slab-on-grade basement floors caused by swelling soils. However, due to the increase in the price of homes, homeowners have begun to look to basements for additional living space and have raised their expectations of basement slab performance and thus their sensitivity to basement floor heave.

To address the home buyers' desire for habitable basements, homebuilders have tried a number of different methods to combat the problem of expansive soils. These methods have varied from treating the expansive soil itself in an attempt to reduce the amount of differential heave, and thus prolong the life of slab-on-grade basement floors, to abandoning the slab-on-grade floor in favor of a structural wooden floor which utilizes wood joists to support a wooden floor deck while leaving a space between the floor deck and soil grade to allow the soil to heave and fall below the structural floor.

As an example of treating the expansive soil itself, a builder may attempt to remove the soil and replace it with non-expansive soil from another area. Of course, this entails significant costs for the hauling of the soil to and from the site as well as re-compacting the new soil, particularly since the builder must account for soil wetting depths of 15 feet or more. Alternatively, the builder may treat the expansive soil by pressure injecting an electrochemical treatment into the soil surrounding the building site to attempt to chemically stabilize the expansive soil. Additionally, because it is known that expansive soils only tend to expand when they are wetted, builders may opt to install various drainage systems and moisture barriers, in addition to enforcing strict landscaping requirements, to minimize the amount of soil wetting and thus differential heave in the area of the building site. Unfortunately, these methods directed toward the soil itself have not proven to consistently prevent or reduce soil heave. Thus, due to the expense and unreliable nature of these methods, many home builders have turned to installing alternatives to the slab-on-grade basement floors, as such new floors frequently provide a more reliable solution for the money spent.

As noted above, the most common alternative to the slab-on-grade basement floor is the wooden structural floor which utilizes wooden joists to suspend a wooden decking over the soil in a manner similar to the joist system used to suspend the upper floors of the house. However, wooden floors used in a basement region can suffer from many drawbacks. First, the materials required to construct a wooden structural basement floor can cost significantly more than the materials for a concrete slab-on-grade floor. An additional concern regarding wooden floors relates to a general lack of confidence in the long term durability of a wooden structural floor which is subjected to high levels of humidity or exposure to moisture as is typical in a residential basement. Additionally, the wooden structural floor increases the chances of major damage due to fire, flood or vermin infestation such as termites. Steel structural floors may be installed in the place of wooden structural floors to alleviate many of the concerns relating to moisture, fire and termites, but steel floors raise new problems in that there are very few skilled construction laborers with experience in installing steel floors. Thus, the installed cost of such a floor may be prohibitive.

Unfortunately, regardless of whether the home builder expends his effort on the soil itself or on improving the floor to compensate for the expansive soil, both types of methods involve a significant increase in time and expense that many home buyers are not willing to tolerate, particularly when they can purchase a conventional slab-on-grade house for a lower price and hope to avoid significant damage due to swelling soils.

It is with respect to these and other background considerations, limitations and problems, that the present invention has evolved.

SUMMARY OF THE INVENTION

One of the significant aspects of the present invention pertains to a method of supporting a floor above an area of expansive soil during the construction of a building. The method of the present invention utilizes foam blocks having an elongated channel defined along a top surface thereof and a plurality of supports attached to a bottom surface of the blocks. The supports of the foam blocks are placed on the expansive soil so that the elongated channels of the foam blocks define joist channels extending between opposing foundation walls which surround the area of expansive soil. The joist channels are then poured with concrete which hardens to form concrete joists connected to the foundation wall while maintaining a void between the joists and the expansive soil. The floor is then installed atop the concrete joists and foam blocks. Alternatively, the concrete joists and a concrete floor may be poured simultaneously in a single monolithic pour.

Another aspect of the present invention relates to a method of severing the supports from the foam blocks once the concrete hardens into the rigid joists to delay or avoid the effect of the heaving forces applied to the foam blocks and the concrete joists by the expansive soil. Alternatively, the effective size of the void between the joists and the expansive soil may be increased by forming the supports from a crushable foam material which compresses under the load applied by heaving soils rather than applying that load directly to the concrete joists or the floor.

A further aspect of the present invention relates to forming the elongated channels, and thus the concrete joists, with a trapezoidal shape, wherein the top surface of the joists is narrower in width than the bottom surface of the joists, to prevent the foam blocks from moving downward relative to the concrete joists. In this manner, the foam blocks between the concrete joists may also be used to support loads both during and after the installation of the floor. Furthermore, the trapezoidal shape of the joists combined with the strength of the foam blocks allows a concrete slab floor to be poured in a separate step atop the concrete joists and the foam blocks without separating the foam blocks from the joists.

Another aspect of the present invention pertains to an apparatus for supporting concrete joists and insulating the floor supported on the joists. The apparatus includes an elongated foam block having a top surface which defines an elongated channel running between opposite ends of the foam block. A plurality of supports connected to a bottom surface of the foam block maintain the bottom surface of the block at a predetermined distance above the soil and allow the elongated channels of one or more blocks to extend between opposing foundation walls. Supported in this manner, the elongated channels act as forms to mold concrete joists attached to the opposing foundation walls. Additionally, the foam blocks act to insulate the floor which is installed on top of the concrete joists and the foam blocks. Furthermore, the elongated channels are preferably trapezoidal in shape to prevent movement of the foam blocks relative to the hardened concrete joists, thereby allowing a concrete floor to be poured in a separate step atop the foam blocks and the concrete joists. Additionally, the supports are formed sufficient strength to support the weight of both the joists and a concrete floor so that the joists and the concrete floor can be formed simultaneously in a single monolithic pour.

A more complete appreciation of the present invention and its scope may be obtained from the accompanying drawings, which are briefly summarized below, from the following detailed descriptions of presently preferred embodiments of the invention, and from the appended claims.

DETAILED DESCRIPTION OF THE DRAWING

FIG. 7 is a generalized horizontal section view taken substantially along the plane of line 7—7 in FIG. 5.

FIG. 8 is a section view similar to FIG. 7 illustrating a number of foam supports which have been separating from the foam blocks illustrated in FIGS. 2 and 3.

FIG. 9 is a section view similar to FIG. 5 further illustrating the foam supports separated from the foam blocks after a concrete floor has been poured atop the foam blocks.

DETAILED DESCRIPTION OF THE PREFERRED EMBODIMENTS

Figure 1:
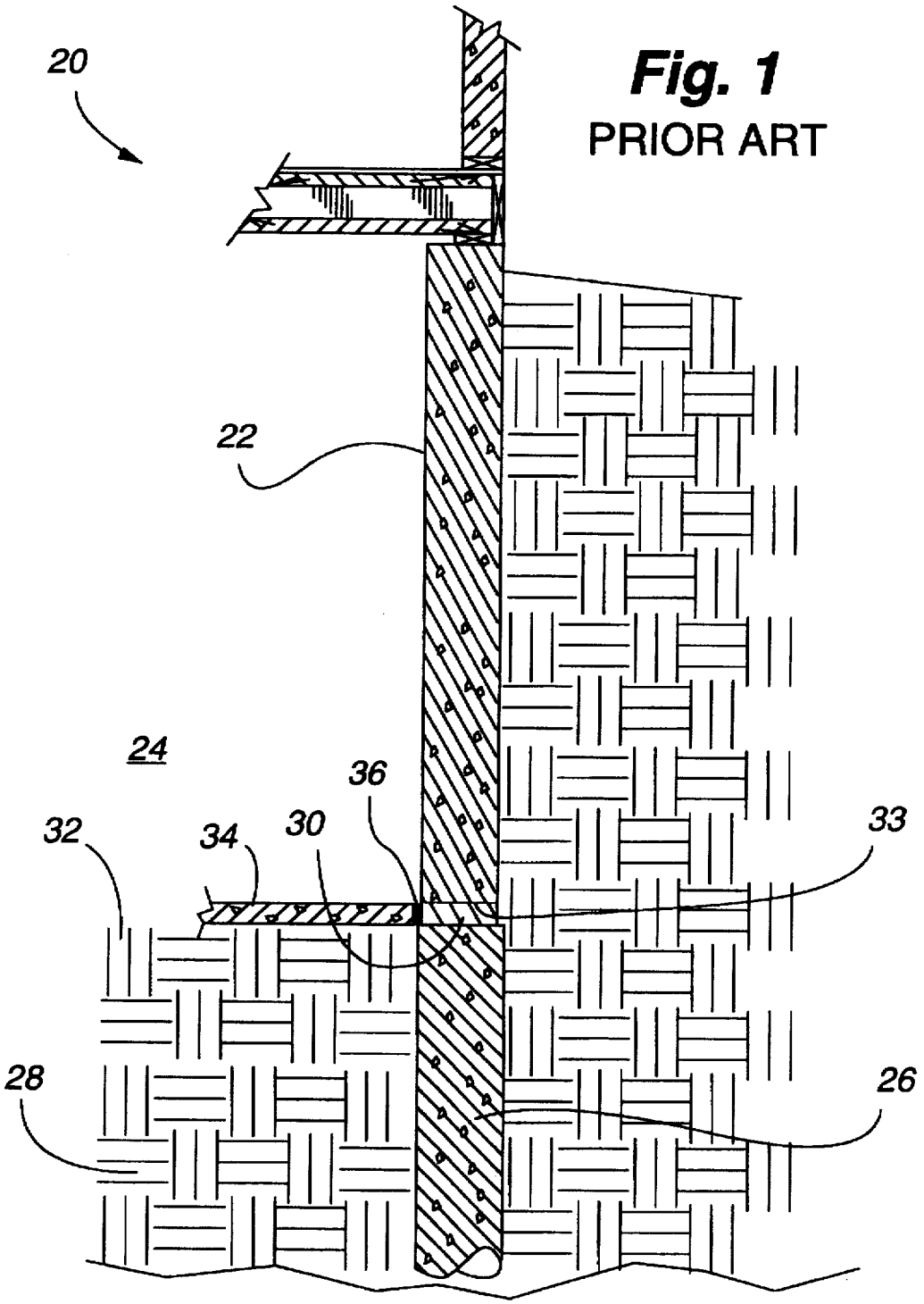
Fig. 1 PRIOR ART
FIG. 1 is a generalized section view of a foundation wall of a building supported on a caisson and illustrating a prior art concrete slab-on-grade basement floor separated from the foundation wall by a slip joint.

The significant improvements available from the present invention are best understood in contrast to a conventional prior art method of installing a concrete slab-on-grade basement floor shown in FIG. 1. A building 20, such as a residential home shown in FIG. 1, includes a concrete foundation wall 22 which forms an outer wall of the basement area 24 of the building 20. The foundation wall 22 is supported at regular intervals along its length by caissons 26 (one of which is shown) which are buried deep into the surrounding soil 28 and preferably attached to bedrock (not shown) beneath the building 20.

The caissons 26 are typically positioned so that an upper end or cap 30 of each caisson 26 extends approximately four inches above the upper level or grade 32 of the soil 28 within the basement area 24. A bottom surface 33 of the foundation walls 22 are thus supported atop the caps 30 of the caissons 26 so that a void of approximately four inches is created between the bottom surface 33 of the foundation walls 22 and the level or grade 32 of the soil 28 between the caissons 26.

Thus, the foundation walls 22 are not supported directly on the soil grade 32 itself, but rather are supported only by the caissons 26. The creation of a void between the bottom surface 33 of the foundation wall 22 and the soil grade 32 within the basement area 24 minimizes the possibility that expansive soils will rise up below the foundation wall 22 and damage the foundation of the building 20. Furthermore, the bottom ends (not shown) of the caissons 26 preferably extend downward to a depth below the level of soil wetting. Therefore, the caissons 26 are not typically affected by the expansive soils which swell upward upon exposure to water. Rather, the soil will tend to heave upward around the upper end of the stationary caissons 26.

Prior to pouring a concrete slab-on-grade floor 34 (FIG. 1), a slip joint 36 is typically installed around the perimeter of the basement area 24 to prevent the concrete floor 34 from contacting the foundation walls 22 or the caissons 26. Once poured, the concrete slab-on-grade floor 34 may then move relative to the foundation walls 22. In this manner, the concrete slab-on-grade floor 34 is supported directly on the soil grade 32 and can thus rise and fall in relation to the foundation walls 22 as the soil 28 heaves upward.

Thus, in summary, the prior art slab-on-grade basement floor 34 shown in FIG. 1 is supported directly on the soil grade 32 and is permitted to move relative to the foundation walls 22 via the slip joint 36. Furthermore, the caissons 26 prevent the swelling soils from damaging the foundation walls 22 themselves by creating a void beneath the bottom surface of the foundation walls 22. Thus, the use of the slip joint 36 was intended to prevent damage to the basement floor 34 or the foundation walls 22 by disconnecting the floor 34 from the walls 22 and allowing the slab-on-grade floor 34 to essentially float atop the expansive soil 28. However, the floating slab-on-grade floor 34 is still subject to significant damage in the form of cracking and differential elevations within the basement area 24 due to the problem of differential soil heave. Furthermore, constructing interior walls within the basement is complicated, because those walls must accommodate vertical movement of the floor.

Figure 4:
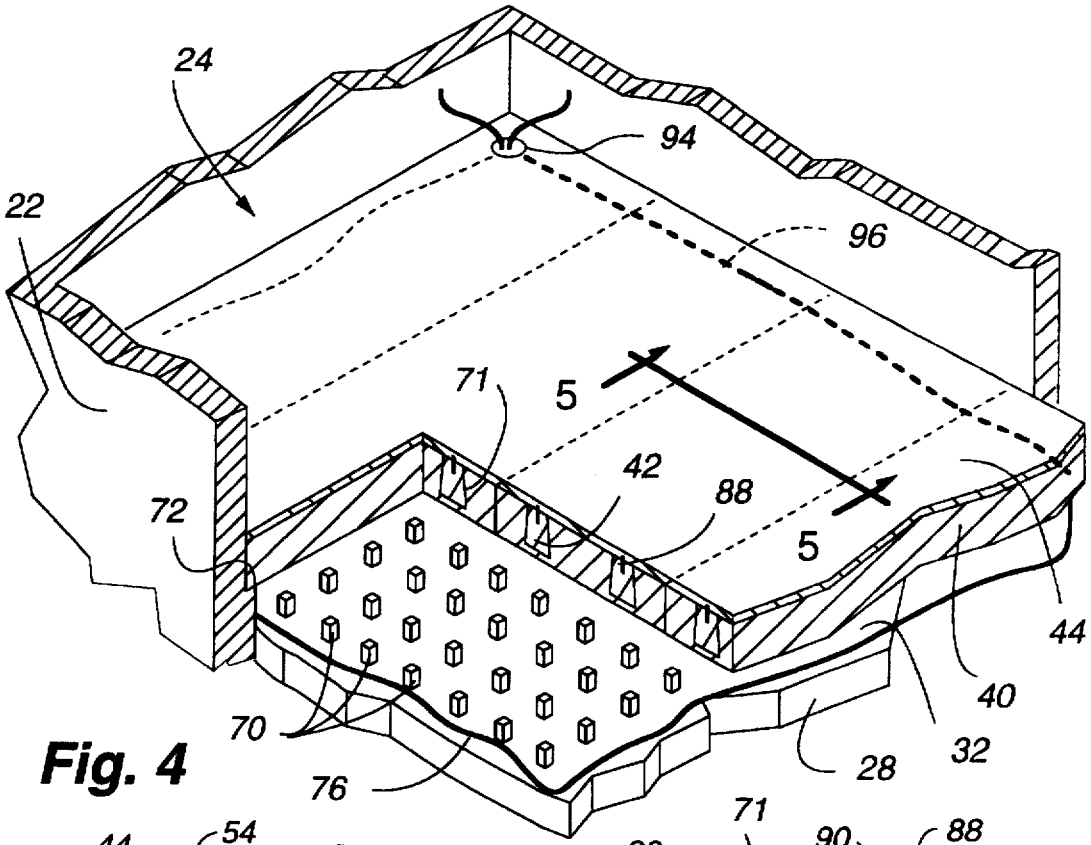
FIG. 4 is a perspective view of a basement of a building utilizing the foam blocks shown in FIGS. 2 and 3, with portions of the floor and the foam blocks broken away for clarity.
Figure 5:
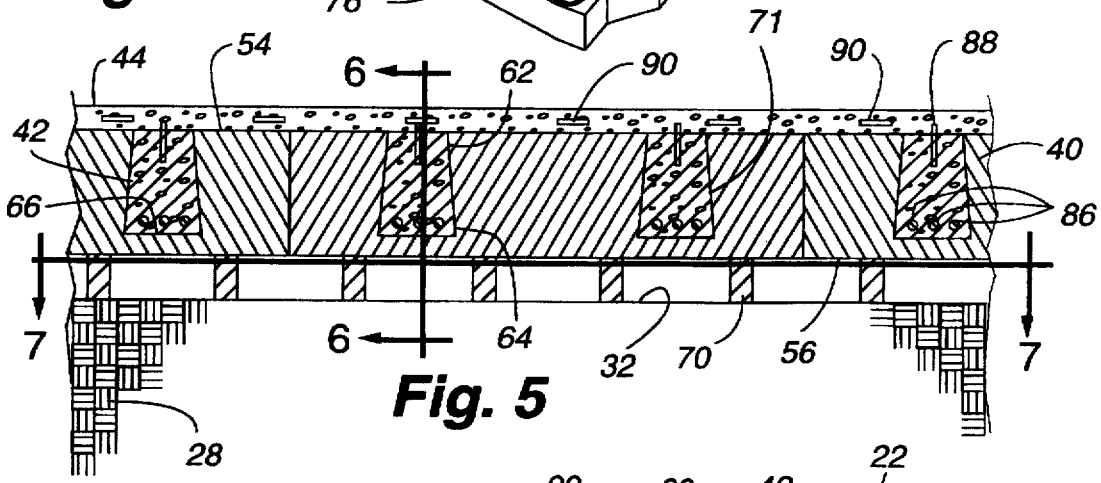
FIG. 5 is an enlarged vertical section view taken substantially along the plane of line 5—5 in FIG. 4.
Figure 6:
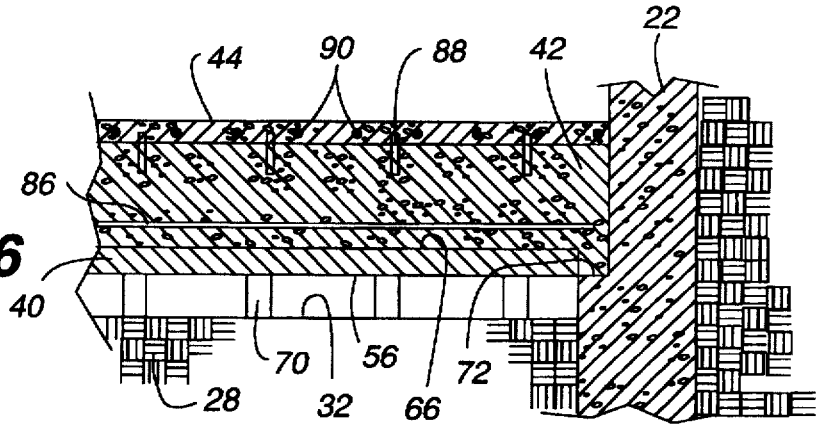
FIG. 6 is a vertical section view taken substantially along the plane of line 6—6 in FIG. 5.

The present invention utilizes foam blocks 40 (FIGS. 2 and 3) which are initially supported by supports 70 atop the soil grade 32 in the basement area 24. The foam of the blocks 40 is preferably of the expanded bead polystyrene (EPS) type, which provides enough structural integrity to maintain the shape of the blocks under the influences described below. The foam blocks 40 provide forms for poured concrete to harden into rigid joists 42 (FIGS. 4–6). The foam blocks 40 are positioned within the basement area 24 so that the concrete joists 42 span the area of the basement between the foundation walls 22, or other foundational structures such as support caissons, and connect to the foundation walls or structures, preferably as shown in FIG. 4. The foam blocks 40 thus suspend the concrete joists 42 above the soil grade 32 and allow the poured concrete to harden into rigid joists connected to the foundation walls 22. Preferably, a concrete slab floor 44 is then poured over top the foam blocks 40 and the joists 42 as shown in FIGS. 4–6, although it is within the scope of the present invention to simultaneously pour the concrete joists 42 and the concrete floor 44 is a monolithic pour. Thereafter, the supports 70 between the foam blocks 40 and the soil grade 32 beneath the floor 44 may or may not be severed (FIGS. 7–9) to enlarge the void, and thus the buffer zone, between the bottom of the foam blocks 40 and the expansive soil 28.

Figure 2:
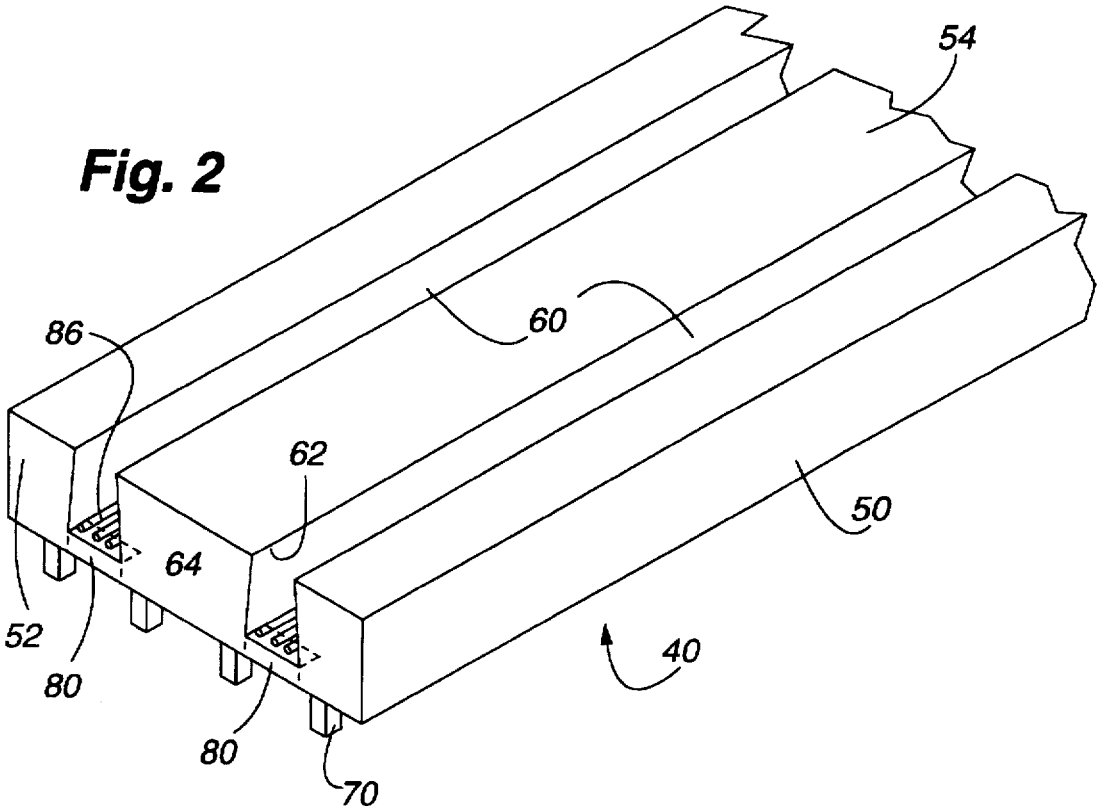
FIG. 2 is a top perspective view of one embodiment of a foam block utilized in practicing the present invention.
Figure 3:
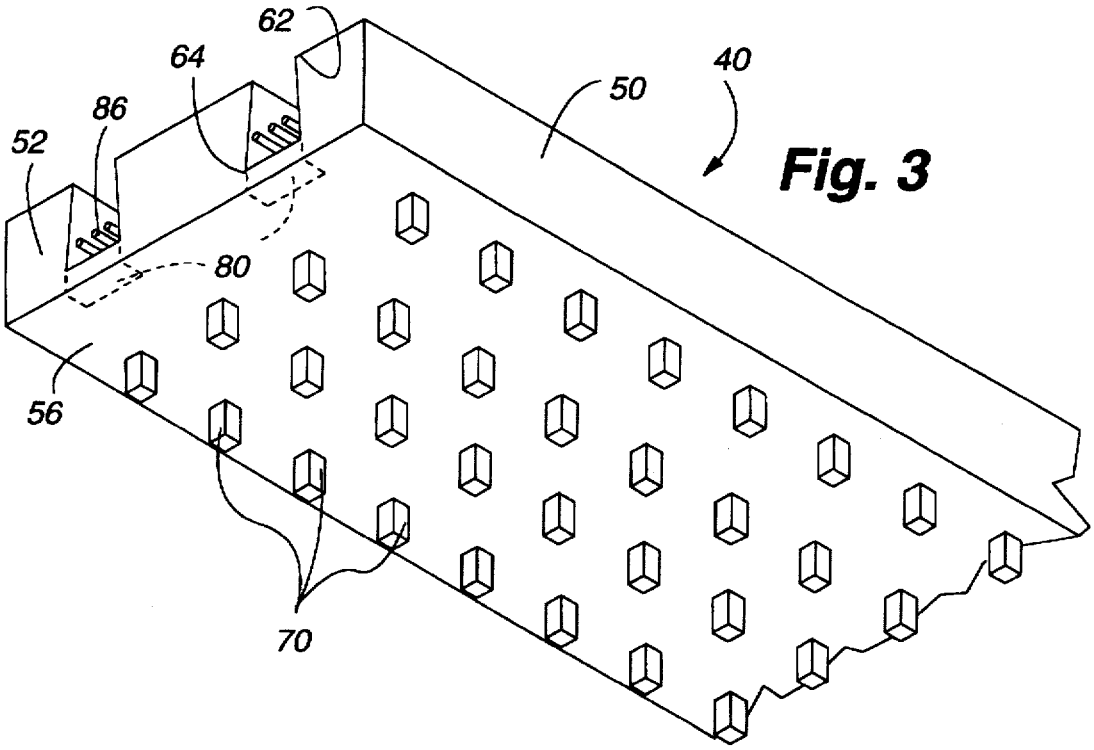
FIG. 3 is another perspective view of the foam block shown in FIG. 2, taken from a bottom perspective.

As shown in FIGS. 2 and 3, the foam blocks 40 are preferably rectangular in shape with a long side 50, a short end 52, a top surface 54 (FIG. 2) and a bottom surface 56 (FIG. 3). The thickness of the foam blocks 40 may vary depending on the length of the joists 42, however the blocks 40 are preferably at least six inches thick. At least one and preferably two channels 60 are formed from the top surface 54 into the foam blocks 40, as best shown in FIG. 2. The channels 60 are preferably formed with a trapezoidal cross-section (FIGS. 2 and 5) having a top end 62 at the top surface 54 of the foam block 40 which is narrower than a bottom end 64 adjacent to the bottom surface 56 of the block 40. The channels 60 do not extend through the bottom surface 56 of the foam blocks 40 and thus the channels 60 define trapezoidal passageways, having an open top and a floor 66, which extend along the length of the blocks 40, as shown in FIG. 2. In the preferred embodiment, the channels 60 preferably have a depth which is approximately two inches less than the thickness of the foam blocks 40 (e.g., for a block thickness of twelve inches, the channels are approximately ten inches deep). The thickness of the channels and hence the thickness of the foam blocks depends on the length to be spanned by each joist 42. The ratio of the joist span length to the joist thickness, and the amount of reinforcing bars required, are determined by commonly available concrete construction information. The thickness of the foam block between the floor 66 of the channel 60 and the bottom surface 56 of the block 40 must be sufficient to withstand the weight of the concrete poured into the channel while the concrete hardens. The channels 60 are preferably formed during the creation of the foam blocks 40 through the use of a specially shaped foam mold, although the channels 60 may also be cut with a hot wire into the top surface 54 of the foam blocks 40 after the formation of the rectangular blocks 40.

A plurality of supports 70 are attached to the bottom surface 56 of each foam block 40. The supports 70 are also preferably made from foam and preferably are rectangular in shape having one long dimension and square in cross-section. The foam supports 70 thus preferably include two square ends, one of which is attached to the bottom surface 56 of the foam blocks 40 while the opposing square end extends away from the foam block 40, as shown in FIG. 3. Although more details regarding the specifications of the supports are described below, the preferred embodiment of the supports 70 are two inches square by four inches long and are preferably spaced approximately twelve inches from one another along both the length and width dimensions of the foam block 40. A bonding agent such as glue is preferably used to attach the supports 70 to the bottom surface 56 of the foam blocks 40, although it is within the scope of the present invention to form both the foam block 40 and the foam supports 70 as a single integral piece of foam. Similarly, as described in greater detail below, it is within the scope of the present invention to utilize a support 70 made from other materials.

Predetermined lengths of the foam blocks 40 are placed within the basement area 24 of the building 20 after the foundation walls 22 have been erected. The blocks 40 are preferably placed adjacent one another to fill the entire area of the basement region, as shown in FIG. 4. The blocks 40 are supported atop the grade 32 of the soil 28 by the supports 70 (FIGS. 5 and 6) so that one or more of the channels 60 extend from one foundation wall 22 to an opposite wall 22, or between other foundation structures (not shown), to form a joist channel 71.

The foundation walls 22 preferably include a ledge or notch which defines a horizontal flat surface 72 extending a predetermined height above the soil grade 32 (FIG. 6). The predetermined height is preferably equal to the length dimension of the supports 70 and, in the preferred embodiment, is approximately four inches. As shown in FIGS. 3 and 6, the supports 70 preferably do not extend to the sides 50 or ends 52 of the foam blocks 40. Thus, when the foam blocks 40 are positioned atop the soil grade 32 so that the supports 70 contact the soil (FIGS. 4–6), the short ends 52 of each foam block 40 are preferably flush with the foundation walls 22 so that a portion of the bottom surface 56 adjacent each end 52 overlaps and is supported by the flat surface 72 of the foundation wall 22 (FIG. 4). A portion 80 (FIGS. 2 and 3) of the channel floor 66 adjacent each end 52 of the foam blocks 40 which overlies the flat surface 72 is then preferably cut out so that the channel floor 66 terminates at an edge of the flat surface 72 of the foundation wall 22 (FIG. 6).

Thus, when the foam blocks 40 are arrayed side-by-side within the basement area 24, as shown in FIG. 4, the blocks are supported at their ends 52 by the flat surface 72 and are supported along their length by the supports 70. In this manner, the bottom surface 56 of the foam blocks is positioned a predetermined distance (e.g., four inches) above the grade 32 of the expansive soil 28. However, prior to fitting the foam blocks 40 within the basement area 24, a cable, cord or rope 76 is preferably laid about the perimeter of the basement area, as best shown in FIG. 4. The rope 76 is preferably laid out so that both ends of the rope coincide at one corner of the basement adjacent the junction of two foundation walls 22. Because the supports 70 do not extend to the sides 50 or the ends 52 of the foam blocks 40 (FIG. 3), the position of the rope 76 along the foundation walls 22 does not interfere with the positioning of the foam blocks 40 within the basement area 24, as shown in FIGS. 4 and 7. After the foam blocks 40 have been positioned within the basement area, the ends of the rope 76 are inserted upward through an opening (not shown) in one of the foam blocks 40 so that the ends of the rope 76 may be accessed from atop the foam blocks 40. Further details regarding the rope 76 and its function are discussed below.

Next, the joist channels 71 are filled with fluid concrete to form the concrete joists 42 (FIGS. 5 and 6). Because the portions 80 have been removed from the ends of the channel floors 66 as described above, the concrete within the joist channels 71 extends between opposing foundation walls 22 and forms directly against the flat concrete surface 72 of the foundation walls 22. Thus, the cut-out portion 80 allows the joists 42 to be directly supported on the flat surface 72 of the foundation walls 22, as best shown in FIG. 6. This direct concrete-to-concrete connection establishes support for the joists 42.

To provide additional strength and rigidity for the concrete joists 42, reinforcing bar rods 86 are preferably placed within the channels 60 prior to pouring the concrete. Metal chairs (not shown) are fitted into the sides of the channels 60 adjacent the floor 66 to suspend one or more reinforcing bar rods 86 (three rods 86 are shown in FIG. 5) above the floor 66 of the channel before the concrete is poured into the channels 60. As the concrete within the joist channels 71 hardens around the reinforcing bar rods 86, the rods 86 act to reinforce the joists 42 and enhance the tensile strength of the joists.

Before the concrete within the joist channels 71 hardens to form the joists 42, metal dowel rods 88 (FIGS. 5 and 6) are preferably inserted into the concrete so that one end of the dowel rods 88 protrudes above the top surface 54 of the foam blocks 40. Due to the thickness of the foam blocks 40, as well as the support supplied both along the length of the blocks 40 by the supports 70 and at the ends of the blocks by the flat surface 72 of the foundation walls 22, the blocks 40 can not only withstand the weight of the concrete-filled channels 60, but can also withstand the weight of workers walking upon the blocks to insert the metal dowel rods 88 before the concrete dries to form the joists 42. The dowel rods 88 ultimately connect the joists 42 to the concrete slab floor 44, as will be described in greater detail below. Alternatively, the joists 42 and the concrete floor 44 may be poured in a single step, thereby eliminating the need for the dowel rods 88, as described in greater detail below.

Once the concrete joists 42 harden within the channels 71, the joists 42 provide the main load bearing structure for the floor 44 since the concrete joists 42 are supported directly by the foundation walls 22. However, as the joists 42 cure within the channels 71, the load bearing capability of the foam blocks 40 is enhanced due to the trapezoidal shape of the channels 71 (see FIG. 5). In effect, the trapezoidal shape of the channels resists the foam blocks 40 from being pushed down and away from the joists 42 as loads are placed upon the top surface 54 of the foam blocks 40. Thus, once the concrete joists 42 have cured properly within the trapezoidal channels 71, significant loads may safely be placed atop both the joists 42 and the areas of foam between the joists 42. For example, workers may freely walk about the entire basement area 24 to inspect the joists 42 and their connection to the foundation walls 22. Additionally, as described below, a concrete floor 44 may be poured on top of the blocks 40 using the blocks as forms between the joists 42.

In addition to the advantage of being able to walk upon the foam blocks 40 after the hardening of the joists 42, heating elements may be incorporated in the floor 44. Typical heating elements would include liquid heating coils 90 (FIGS. 5 and 6) or electrical heating elements, for example. It is often desirable to embed heating coils within the floor if the basement is to be used as a living area due to the cooler temperature of the subterranean soil 28. While carpeting and above-ground insulation may help to reduce the heat loss, heating coils are still desirable to provide a warm floor similar to the wooden flooring used in the upper floors of the building 20. However, while heat loss is a concern with slab-on-grade concrete floors 34, the floor 44 of the present invention substantially reduces the amount of heat transferred from the floor 44 to the soil 28. Indeed, the foam blocks 40 of the present invention, together with the void created between the floor 44 and the expansive soil 28, tend to insulate the floor 44 from the relatively cool soil 28. Of course, the basement will still typically be cooler than the upper floors of the building 20 and, therefore, the present invention allows the heating coils 90 to be easily added within the floor 44 to supplement the basement heating system.

Once the joists 42 have hardened within the channels 71, the concrete slab floor 44 is poured directly on top of the joists 42 and the top surface 54 of the foam blocks 40. The foam blocks 40 provide a level surface on which to pour the concrete and support the wet concrete floor 44 as it hardens into the floor 44. However, once the concrete slab floor 44 has cured, the floor 44 is primarily supported by the concrete joists 42 which, in turn, are supported by the foundation walls 22.

The concrete slab floor 44 is preferably poured with sufficient thickness to cover the ends of the metal dowel rods 88 protruding from the joists 42, the heating coils 90 and any reinforcing bars (not shown) embedded within the floor 44, as shown in FIGS. 5 and 6. The connection of the floor 44 to the dowel rods 88 protruding from the joists 42 helps to prevent shifting or movement of the floor 44 relative to the joists 42.

Alternatively, as discussed above, the joists 42 and the floor 44 may be poured simultaneously in a single monolithic pour where the supports 70 must support the weight of both the concrete joists 42 and the concrete floor 44. One benefit of the single monolithic pour over the two-pour technique described above is that the thickness of the joists 42 is effectively increased thereby enhancing the strength of the joists (i.e., the thickness of the joist 42 is equal to the distance from the floor 66 of the channels 60 to the top surface of the floor 44 as opposed to the top surface 54 of the block 40). While heating coils 90 can still be embedded within the floor 44 by placing the coils atop the blocks 40, a monolithic pour would not require the use of the dowel rods 88 to connect the joists 42 to the floor 44.

Furthermore, regardless of whether the joists 42 and the floor 44 are poured separately or simultaneously, because the joists 42 bear the weight of both the floor 44 and all the items (e.g., furnaces, water heaters, furniture, etc.) placed upon the floor 44, and further because the floor 44 will not typically be exposed to the heaving forces typically experienced by conventional slab-on-grade concrete floors 34, the thickness of the poured concrete floor 44 may be less than that of the prior art slab-on-grade concrete floor 34. For example, the concrete floor 44 is preferably two inches thick.

Prior to pouring the concrete floor 44, a sleeve 94 is preferably positioned within the aforementioned opening (not shown) in the corner foam block 40. The ends of the rope 76 are then extended through the sleeve 94 prior to pouring the concrete floor 44. The sleeve 94 thus prevents concrete from draining through the opening in the foam block and allows the ends of the rope 76 to extend above the concrete floor 44, as shown in FIG. 4.

Once the concrete slab floor 44 has cured so that the load generated by the floor 44 is primarily supported by the joists 42, the supports 70 are no longer required to support the weight of the blocks 40 and the joists 42. Furthermore, because the supports 70 are in direct contact with the expansive soil 28, the supports 70 tend to receive any forces generated by the upward heaving of the soil and transfer such forces to the foam blocks 40. To reduce or postpone the lifting effects of the expansive soil 28, the supports 70 are preferably either formed from a crushable foam material, or are detached from the bottom surface 56 of the foam blocks, or both.

In the first instance, the supports 70 are preferably made from a crushable foam material, such as the EPS foam described above, so that the foam supports 70 may be left attached to the foam blocks 40 after the floor 44 has been poured. The preferred size (e.g., two inches square by four inches long) and layout of the supports 70 attached to each foam block 40 (FIGS. 2 and 3) allows the supports 70 to support the load of the concrete joists 42, as well as the weight of workers walking across the top surface 54 of the foam blocks 40, without crushing or deforming. However, those same foam supports 70 are sized in a predetermined manner to crush under the force of the swelling soil before they transmit loads to the joists 42 or the floor 44 sufficient to raise the joists 42 and the floor 44 from the foundation surfaces 72 (FIG. 6). Sizing the supports 70 involves determining the appropriate cross-sectional size of the supports 70 for a given predetermined length (i.e., the length being equal to the height that the foundation wall surfaces 72 extend above the soil grade 32) and for a given foam material so that the supports 70 will hold the weight of the wet concrete within the channels without crushing but will tend to compress when any greater loads are placed upon the supports 70 by the expanding soil 28. The size of the supports also depends on the spacing of the supports along the bottom surface 56 of the blocks 40. This spacing is determined, at a minimum, by the strength of the foam blocks 40 (i.e., the thickness of the foam between the channel floor 66 and the bottom surface 56 of the blocks 40). However, the supports are preferably spaced along the bottom surface 56 so that they do not underlie the channels 60 and hence the concrete joists 42 formed within the joist channels 71 (FIG. 5) so that any loads which are transferred by the supports 70 after they have been compressed will be transmitted to the portions of the foam blocks 40 extending between the joists 42.

Taking for example the four-inch long foam supports 70 described in the preferred embodiment of the present invention, these supports 70 may be compressed to a fraction of their size and will tend to flatten before they become essentially incompressible and begin to transfer the full load of the heaving soil to the foam blocks 40. Thus, if a builder does not wish to sever the supports 70 from the foam blocks 40 as described below, the supports can be made from a crushable foam material which is sized to support the weight of the concrete joists 42 without crushing, but which will crush under any significantly greater load. In this manner, when the expansive soil 28 heaves upward in an attempt to lift the floor 44, the foam supports 70 will crush to a fraction of their length before transferring the lifting force of the soil to the floor 44. Additionally, once the foam supports 70 are substantially compressed, the foam blocks 40 will tend to deform under any further soil expansion due to the positioning of the supports 70 between the channels 60, thereby delaying transfer of the upward soil loads to the concrete joists 42.

Furthermore, regardless of whether the supports 70 are formed from crushable foam or some other material, the builder may disconnect the supports 70 from the bottom surface 56 of the foam blocks 40 through the use of the rope 76, thereby severing the connection between the foam blocks 40 and the soil grade 32. Since the rope 76 extends around the perimeter of the basement area 24, the rope encompasses all of the supports 70 as shown in FIG. 7. Thus, by pulling the rope 76 upward through the sleeve 94, the loop of the rope contracts and breaks the supports 70 off of the bottom surface 56 of the foam blocks 40, as shown in FIG. 8. Breaking off the supports 70 in this manner effectively increases the size of the void between the blocks 40 and the soil 28.

Taking for example the preferred embodiment of the blocks 40 where the supports 70 are two inches square and four inches tall, once the rope 76 severs the connection between each support 70 and its corresponding foam block 40, the supports 70 fall over onto their sides (FIGS. 8 and 9) so that a two inch gap is formed between the side of each support 70 and the bottom surface 56 of the blocks 40. Additionally, even when the supports 70 have fallen onto their long sides as illustrated in FIG. 8, the supports still cover only a minority of the soil grade 32 beneath the bottom surface 56 of the blocks 40 so that a full four inch void remains between the soil grade 32 and a majority of the bottom surface 56. Furthermore, although the supports 70 are preferably left in place below the floor 44, provision may be made to evacuate the supports 70 after they have been detached from the foam blocks 40 by the rope 76. For example, the sleeve 94 may be sufficiently large to allow a vacuum tube to be inserted into the void between the blocks 40 and the soil 28 so that the severed supports 70 can be suctioned from the void.

Regardless of whether the severed supports 70 are removed or are left in place beneath the floor 44, a significant amount of soil expansion and differential heave can be accommodated before any loads are transferred to the bottom surface 56 of the foam blocks 40. Indeed, even where the severed supports 70 are left beneath the floor 44, the supports 70 only take up a small percentage of the total volume of the void between the blocks 40 and the soil 28. For example, given the dimensions of the preferred supports 70 noted above, it is estimated that the discarded supports 70 will fill approximately three percent of the volume between the bottom surface 56 of the blocks 40 and the soil 28.

However, in the event that the soil 28 ultimately expands to fill even the four inch void created beneath the foam blocks 40, it is desirable that the foam blocks 40 also crush before loads from the heaving soil are transmitted directly to the floor 44. In this manner, the crushable foam blocks 40 will also tend to compress under the high loads applied by the swelling soils, and will thus delay or reduce the transmission of those soil loads to the joists 42 and the floor 44.

Furthermore, should the soil continue to swell past the point that both the foam supports 70 and the foam blocks 40 have been completely crushed, the foam blocks 40 will still help to distribute the upward soil forces more evenly along the concrete joists 42 and the floor 44. Additionally, the joists 42, reinforced with the reinforcing bar rods 86, will also tend to distribute any upward forces more evenly along the floor 44.

Of course, if a wooden basement floor or a basement floor comprising any material other than concrete is desired, the present invention may still be beneficially used to install such a floor. For example, once the concrete joists 42 have been formed within the joist channels 71, another type of floor may be constructed over the top surface 54 of the foam blocks 40 and the joists 42.

Thus, the present invention provides for a basement floor (preferably a concrete floor) with greatly enhanced survivability in areas of expansive soils, particularly in relation to conventional slab-on-grade concrete floors. First, the present invention utilizes reinforced concrete joists 42 to support the floor 44 above the expansive soil 28. The use of the foam blocks 40 to initially support the concrete joists 42 as they harden, and the subsequent detachment of the supports 70 from the blocks 40 and/or the sizing of the foam supports 70 to allow crushing of the supports, provides for an effective void between the joists 42 and the grade 32 of the expansive soil 28. That void greatly enhances the long-term survivability of the floor 44 since it reduces the likelihood that the expansive soil 28 will ever contact the foam blocks 40 and the joists 42. Secondly, should the soil 28 ultimately expand to push against the concrete joists 42, the reinforced joists are capable of withstanding much greater bending (i.e., lifting) forces than conventional slab-on-grade concrete floors (e.g., the floor 34 in FIG. 1), thereby increasing the overall strength or resistance of the floor 44 to damage due to differential soil heave.

Additionally, while it is known to use structural floors to provide a space between a wooden basement floor and expansive soil, such structural floors suffer from high costs, construction delays and doubtful long-term reliability as discussed above. Furthermore, wooden structural floors do not provide the inherent strength of the ribbed concrete slab floor 44 and would be unlikely to survive should the expansive soil ultimately swell to such a degree that it contacts the wooden structural floor. Indeed, to prevent such an eventuality, wooden structural floors must typically allow for a larger gap between the floor and the soil than the preferable four inch gap described above, and thus such structural floors typically require the digging of a deeper foundation to maintain the same basement ceiling height that is provided with the joists 42 and the floor 44 of the present invention.

While non-wooden structural floors may also be suspended above the expansive soil (e.g., steel structural floors), such floors typically require specialized construction skills which, in turn, typically raises the cost and the time required for building the structure. However, the present invention requires no specially trained workers and typically requires only minimal additional construction time in relation to a typical slab-on-grade concrete floor. Indeed, workers need only arrange the blocks 40 on the graded soil, pour the joists 42 and then pour the concrete floor 44 once the joists 42 have cured sufficiently. Alternatively, the joists 42 and the floor 44 may be poured simultaneously in a single monolithic pour. Furthermore, because the foam blocks 40 may be cut to the precise measurements of the basement floor prior to the start of construction, the floor 44 can typically be poured within a day. Additionally, standard foam blocks 40 can easily be cut or trimmed to a new size with no appreciable delay.

Thus, the present invention represents a construction approach to avoiding the problem of expansive soils, which problem has not been adequately addressed either by conventional slab-on-grade concrete floors or expensive and time-consuming structural floors. Additionally, the present invention provides a number of extra benefits in relation to slab-on-grade concrete floors and structural wooden floors. First, the foam blocks 40 provide a significant amount of insulation between the floor 44 and the relatively cold soil 28. Neither slab-on-grade concrete floors nor structural floors provide such inherent insulation benefits. Second, both the concrete floor 44 and the foam blocks 40 are fire resistant and thus may be safer than wooden structural floors. Additionally, the concrete floor 44 is much more water resistant than a wooden floor. Furthermore, the concrete slab floor 44 is resistant to rodents or insects which not only prevents damage to the floor itself (such as by termites), but also prevents rodents from gaining access to the remainder of the building 20 through the basement floor. While conventional slab-on-grade concrete floors share many of the same benefits relative to wooden structural floors (with the notable exception of a lack of insulation), the slab-on-grade floors are extremely susceptible to damage from swelling soils.

A presently preferred embodiment of the present invention has been described above with a degree of specificity. It should be understood, however, that this degree of specificity is directed toward the preferred embodiment. The invention itself is defined by the scope of the appended claims.

The invention claimed is:

1. A method of supporting a floor above an area of soil bounded by foundation walls, said method comprising:

supporting elongated foam blocks above the soil between the foundation walls, each said foam block having supports attached to a bottom surface of the foam blocks to support the foam blocks a predetermined distance above the soil, and each said foam block further defining at least one elongated channel formed from a top surface of the foam block;

positioning the foam blocks and the elongated channels of the foam blocks to define joist channels extending between opposing foundation walls and suspended above the soil;

pouring concrete into each joist channel;

allowing the concrete within the joist channels to harden into rigid concrete joists supported above the soil by the opposing foundation walls; and supporting the floor from and above the joists.

2. A method as defined in claim 1, further comprising the step of:

severing the attachment between the supports and the bottom surface of the foam blocks after the step of allowing the concrete within the joist channels to harden.

3. A method as defined in claim 2, further comprising the step of:

determining the predetermined distance to be sufficient to accommodate any anticipated expansion of the soil.

4. A method as defined in claim 2, further comprising the step of:

removing the severed supports from beneath the foam blocks.

5. A method as defined in claim 2, further comprising the step of:

spacing the supports along the bottom surface of the foam blocks so that the supports are positioned between the joist channels.

6. A method as defined in claim 2, further comprising the step of:

placing an elongated reinforcing bar rod within each elongated channel prior to the step of pouring concrete into each joist channel.

7. A method as defined in claim 2, wherein the supports are formed from a foam material.

8. A method as defined in claim 7, further comprising the step of:

sizing the foam supports to crush upon the application of an expansion force from the soil which is greater than the weight of the joists.

9. A method as defined in claim 2, further comprising the step of:

positioning dowel rods within the joist channels after the step of pouring concrete into each joist channel and prior to the step of allowing the concrete within the joist channels to harden, said dowel rods being positioned within the joist channels so that one end of each dowel rod protrudes a predetermined length above the concrete joists after the concrete within the joist channels has hardened; and wherein:

the step of supporting the floor further comprises pouring concrete to a predetermined depth on top of the concrete joists and the top surface of the foam blocks, said predetermined depth being greater than the predetermined length which the dowel rods protrude above the concrete joists.

10. A method as defined in claim 9, further comprising the step of placing heating coils on top of the concrete joists and the top surface of the foam blocks prior to the step of pouring concrete to the predetermined depth.

11. A method as defined in claim 2 wherein the floor is formed from concrete, said method further comprising the step of:

pouring concrete on top of the foam blocks to form the floor substantially simultaneously with the step of pouring concrete into each joist channel.

12. A method as defined in claim 1, wherein the supports are formed from a foam material.

13. A method as defined in claim 12, further comprising the step of:

determining the predetermined distance to be sufficient to accommodate any anticipated expansion of the soil.

14. A method as defined in claim 12, further comprising the step of:

spacing the foam supports along the bottom surface of the foam blocks so that the supports are positioned between the joist channels.

15. A method as defined in claim 12, further comprising the step of:

sizing the foam supports to crush upon the application of an expansion force from the soil which is greater than the weight of the joists.

16. A method as defined in claim 15, further comprising the step of:

placing an elongated reinforcing bar rod within each elongated channel prior to the step of pouring concrete into each joist channel.

17. A method as defined in claim 15, further comprising the step of:

positioning dowel rods within the joist channels after the step of pouring concrete into each joist channel and prior to the step of allowing the concrete within the joist channels to harden, said dowel rods being positioned within the joist channels so that one end of each dowel rod protrudes a predetermined length above the concrete joists after the concrete within the joist channels has hardened; and wherein:

the step of supporting the floor further comprises pouring concrete to a predetermined depth on top of the concrete joists and the top surface of the foam blocks, said predetermined depth being greater than the predetermined length which the dowel rods protrude above the concrete joists.

18. A method as defined in claim 15, further comprising the step of:

severing the attachment between the supports and the bottom surface of the foam blocks after the step of allowing the concrete within the joist channels to harden.

19. A method as defined in claim 12 wherein the floor is formed from concrete, said method further comprising the steps of:

pouring concrete on top of the foam blocks to form the floor substantially simultaneously with the step of pouring concrete into each joist channel; and sizing the foam supports to crush upon the application of an expansion force from the soil which is greater than a combined weight of the concrete joists and the concrete floor.

20. A method of supporting and insulating concrete joists above an area of soil bounded by foundation walls, said method comprising:

supporting elongated foam blocks above the soil between the foundation walls, each said foam block having supports attached to a bottom surface of the foam blocks to support the foam blocks a predetermined distance above the soil, and each said foam block further defining at least one elongated channel formed from a top surface of the foam block;

positioning the foam blocks and the elongated channels of the foam blocks to define joist channels extending between opposing foundation walls and suspended above the soil;

pouring concrete into each joist channel; and allowing the concrete within the joist channels to harden into rigid concrete joists supported above the soil by the opposing foundation walls.

21. A method as defined in claim 20, further comprising the step of:

determining the predetermined distance to be sufficient to accommodate any anticipated expansion of the soil.

22. A method as defined in claim 21, further comprising the step of:

severing the attachment between the supports and the bottom surface of the foam blocks after the step of allowing the concrete within the joist channels to harden.

23. A method as defined in claim 21, further comprising the step of:

spacing the supports along the bottom surface of the foam blocks so that the supports are positioned between the joist channels.

24. A method as defined in claim 23, wherein the supports are formed from a foam material.

* * * * *